US005980583A

United States Patent [19]

Staub et al.

[11] Patent Number: 5,980,583

[45] Date of Patent: Nov. 9, 1999

[54] APPARATUS AND METHOD FOR IMPARTING WRINKLE-RESISTANT PROPERTIES TO GARMENTS AND OTHER ARTICLES

[75] Inventors: John Christian Staub; Kent Delmar Ubil, both of Garland; Pamela Jane Throgmorton, Lucas, all of Tex.

[73] Assignee: Haggar Clothing Co., Dallas, Tex.

[21] Appl. No.: 09/039,684

[22] Filed: Mar. 16, 1998

Related U.S. Application Data

[62] Division of application No. 08/399,078, Mar. 8, 1995, Pat. No. 5,749,163.

[51] Int. Cl.[6] ..... D06B 1/02

[52] U.S. Cl. ..... 8/149.2; 8/158; 68/5 C

[58] Field of Search ..... 34/60, 72, 342, 34/390, 527, 597, 132; 8/149.1, 149.2, 158; 68/5 C

[56] References Cited

U.S. PATENT DOCUMENTS

| | | | |
|---|---|---|---|
| 3,103,450 | 9/1963 | Janson | 118/48 |
| 3,180,037 | 4/1965 | Kenreich et al. | 34/37 |
| 3,267,701 | 8/1966 | Mandarino | 68/12 |
| 3,364,585 | 1/1968 | Fish et al. | 34/45 |
| 3,872,604 | 3/1975 | Keller | 34/9 |
| 3,877,152 | 4/1975 | Gorman | 34/43 |
| 4,207,683 | 6/1980 | Horton | 34/60 |
| 4,806,254 | 2/1989 | Church | 252/8.6 |
| 5,072,526 | 12/1991 | Hirota et al. | 34/60 |
| 5,320,645 | 6/1994 | Logue et al. | 8/116.1 |

FOREIGN PATENT DOCUMENTS

| | | | |
|---|---|---|---|
| 1313452 | 2/1993 | Canada | 28/23 |

*Primary Examiner*—Philip R. Coe
*Attorney, Agent, or Firm*—Herbert J. Hammond

[57] ABSTRACT

A method of manufacturing durable press garments by inserting garments constructed of a cellulose fiber-containing fabric into an apparatus capable of tumbling the garments about a generally horizontal axis in such a manner as form a tunnel defined by the garments. The method tumbles the garments and injects a durable press resin into the tunnel in the form of a mist to impregnate the garments with the durable press resin. The method dries the impregnated garments and cures the dried garments.

21 Claims, 5 Drawing Sheets

APPARATUS AND METHOD FOR IMPARTING WRINKLE-RESISTANT PROPERTIES TO GARMENTS AND OTHER ARTICLES

CROSS-REFERENCE TO RELATED APPLICATION

This is a divisional application of application Ser. No. 08/399,078, filed Mar. 8, 1995, entitled APPARATUS AND METHOD FOR IMPARTING WRINKLE-RESISTANT PROPERTIES TO GARMENTS AND OTHER ARTICLES, now U.S. Pat. No. 5,749,163, issued May 12, 1998, the disclosure of which is incorporated herein by reference.

TECHNICAL FIELD OF THE INVENTION

The field of the invention is that of wrinkle-resistant garments and more particularly a novel apparatus and method of manufacturing wrinkle-resistant garments.

BACKGROUND OF THE INVENTION

Wrinkle-resistant fabrics and methods of imparting wrinkle resistance to cotton and cotton-blend fabrics are well known in the textile industry and have been used to manufacture wrinkle-resistant or permanent press garments. Typically, wrinkle-resistant fabrics are produced by applying to or otherwise impregnating a fabric with resins or other crosslinking agents and, in the presence of a catalyst, heating the fabric to a temperature at which cross-linking of the reactive fibers, i.e. curing, will occur at the desired rate. Several examples of durable press compositions and processes are discussed below.

U.S. Pat. No. 4,336,023 to Warburton, Jr. discloses a process for treating a fabric for the purpose of rendering the fabric wrinkle-resistant. The disclosed process includes the steps of saturating the fabric with a durable press treatment solution containing an activated bis-vinyl compound, a copolymer, and an aqueous base; passing the fabric through pad rolls; drying the fabric; and curing the fabric.

U.S. Pat. No. 4,623,356 to Hendrix discloses a process to prevent yellowing of durable press fabrics which have been treated with a non-formaldehyde finishing agent such as glyoxal, polymers of glyoxal and higher aldehydes. This process includes exposing a moist finished fabric to an oxidation solution at an elevated temperature, followed by neutralization, rinsing and drying operations. The oxidative treatment may be performed either during or immediately after curing of the finished fabric in a continuous process, or at a later time as a totally separate process.

U.S. Pat. No. 3,488,701 to Herbes discloses a crease-proofing composition comprising certain imidazolidinones. The crease proofing composition of the Herbes patent is applied to cellulosic textile materials. A catalyst or accelerator may also be employed. Following the application of the crease proofing agent and curing catalyst, the material is subjected to drying and curing operations.

U.S. Pat. No. 4,323,624 to Hunsucker discloses using certain urea-aldehyde compositions to treat textiles and nonwoven cellulose products so as to impart wrinkle resistance and durable press properties. Hunsucker further discloses that catalysts such as magnesium chloride and zinc nitrate may also be used. The cellulosic materials are saturated with the composition, pressed and then heated to cure the resin. Hunsucker discloses that the treated fabrics have much improved hand when the treatment is conducted in the presence of nitroalkanes or nitroalkanols, and the residual aldehyde is much reduced, thereby improving the environment.

U.S. Pat. No. 3,656,246 to Lord discloses a method of making a durable press garment which may be conducted in the home. This method includes the steps of pressing an assembled garment to form at least one crease therein, impregnating the garment with a liquid, containing a crease proofing agent, permitting the garment to dry and then heating the garment to cure the crease proofing agent. Lord further discloses that the method may also include the initial fabrication of the garment by cutting and sewing together suitable pieces of fabric and/or repressing the garment after the drying step and before the curing operation.

Other examples of durable press agents and processes are disclosed in U.S. Pat. No. 3,632,296 to Pandell and U.S. Pat. No. 3,181,927 to Roth and in copending patent application Ser. No. 08/078,608.

While known methods of manufacturing durable press garments generally result in garments having satisfactory permanent press or wrinkle-resistant properties, these methods require the use of excess resins which add to the cost of manufacture and pollute the environment and, in most cases, produce garments which exhibit undesirable hand (i.e. excessive stiffness).

The present invention provides a method and apparatus which eliminate the use of excess durable press resins and other chemicals and which yield wrinkle-resistant garments having excellent hand (i.e., softness).

SUMMARY OF THE INVENTION

In accordance with one aspect of the present invention, an apparatus for use in the manufacture of wrinkle-resistant garments comprises a housing enclosing a drum which is rotatable on a generally horizontal axis, whereby when the drum is rotated with garments disposed therein a tunnel defined by the garments is formed. Hingedly secured to the housing is a door. A blower and a heating element are arranged to provide heated airflow from the top of the apparatus through the drum in a vertically downward direction. A vent located below the drum is provided for the exhaustion of the heated air. Known commercial tumble dryers may be used for this aspect of the invention. Mounted on the door, exterior to the housing and drum when the door is in a closed position, is an atomizer unit positioned to discharge a durable press resin in the form of a mist through a hole in the door and into the garment tunnel when the door is closed. Preferably, the apparatus includes a dampener or other means for controlling the exhaustion of air in order to achieve a more uniform wetting of the garments with durable press resin. In practice, durable press resin is fed into the atomizer unit while the garments are being tumbled until the garments are sufficiently wetted with the resin. The wetted garments are then ready for curing to impart wrinkle-resistant properties to the garments.

In another embodiment of the present invention a programmable controller is used for controlling the dampener, the blower and the heating element. Further, a second atomizer unit may also be used and mounted to the door to improve the efficiency of the apparatus.

In a particular embodiment of the method of the present invention, a durable press garment is manufactured by inserting garments constructed of a cellulose fiber-containing fabric (such as cotton) into an apparatus capable of tumbling the garments in such a manner as form a tunnel defined by the garments. While the garments are being tumbled a durable press resin is injected into the tunnel in the form of a mist, impregnating (i.e., wetting) the garments with durable press resin. The wetted garments are then dried and cured, resulting in a wrinkle-resistant garment. Further, prior to curing, the garments may be pressed to impart creases and shape to the garments as is often desired.

These an other aspects of the present invention are described with greater specificity in the following detailed description of the invention.

BRIEF DESCRIPTION OF THE DRAWINGS

For a more complete description of the present invention and the advantages thereof, reference is now made to the following description taken in conjunction with the accompanying drawings in which.

DETAILED DESCRIPTION

Figure 1:
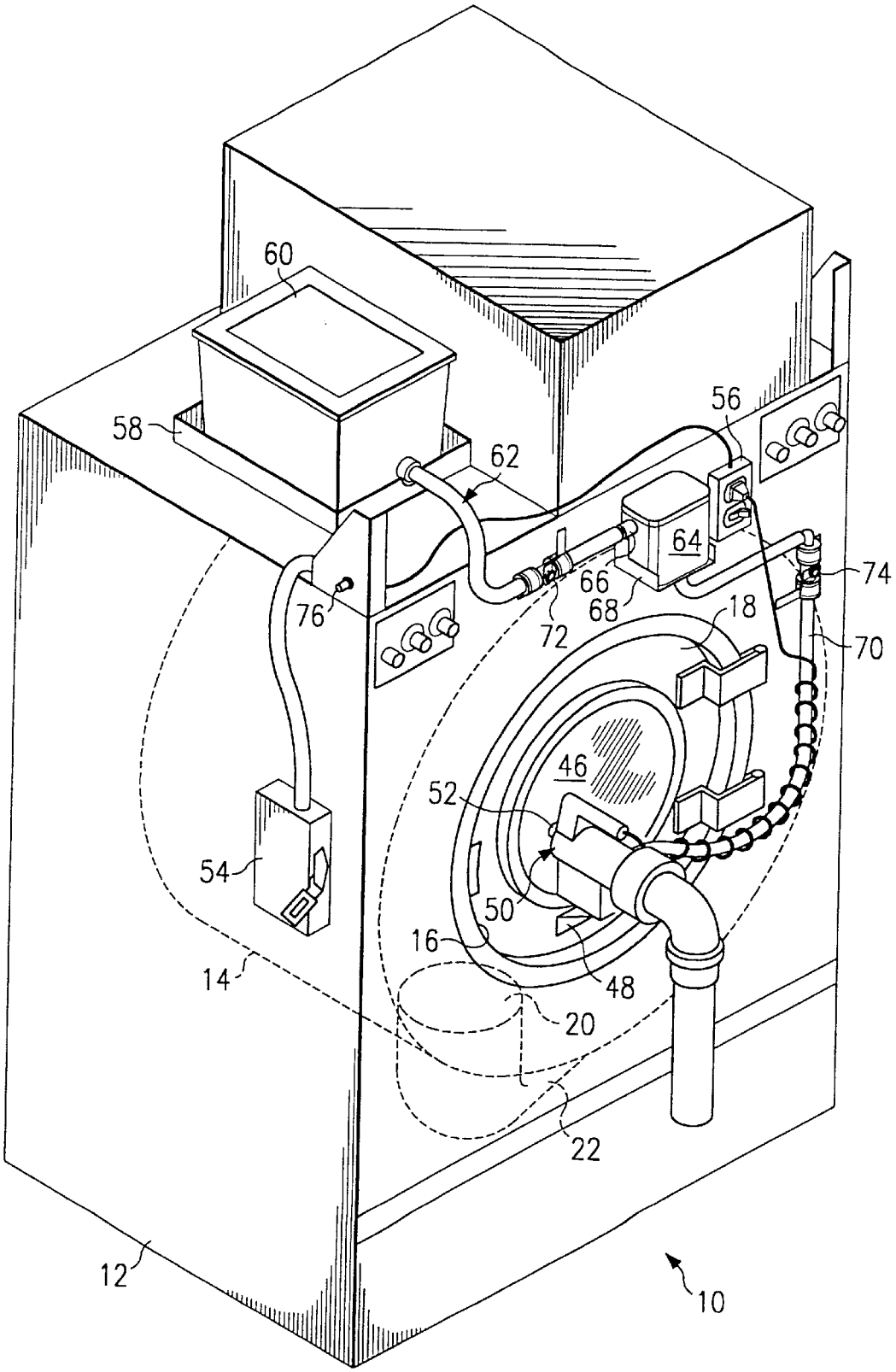
FIG. 1 is a front perspective view of a modified tumbler/dryer apparatus embodying features of the present invention.

In accordance with the subject invention, a novel apparatus and process is provided for producing garments having wrinkle-resistant properties and excellent hand.

In the exemplary embodiment of the invention, as disclosed in FIGS. 1–4, a commercial tumble dryer generally designated 10 is shown to comprise an external housing 12, within which is mounted a tumbling drum 14 having a forward access opening 16. The tumbling drum 14 may be mounted in any usual or preferred manner to be driven rotatably by suitable power means, most typically an electric motor and control circuitry well known in the construction of commercial tumble dryers. A preferred commercial dryer is the Huebsch Model JT120FG 120 lb. capacity commercial dryer. Hingedly mounted on the front of the dryer housing 12 is.—an access door 18.

Figure 2:
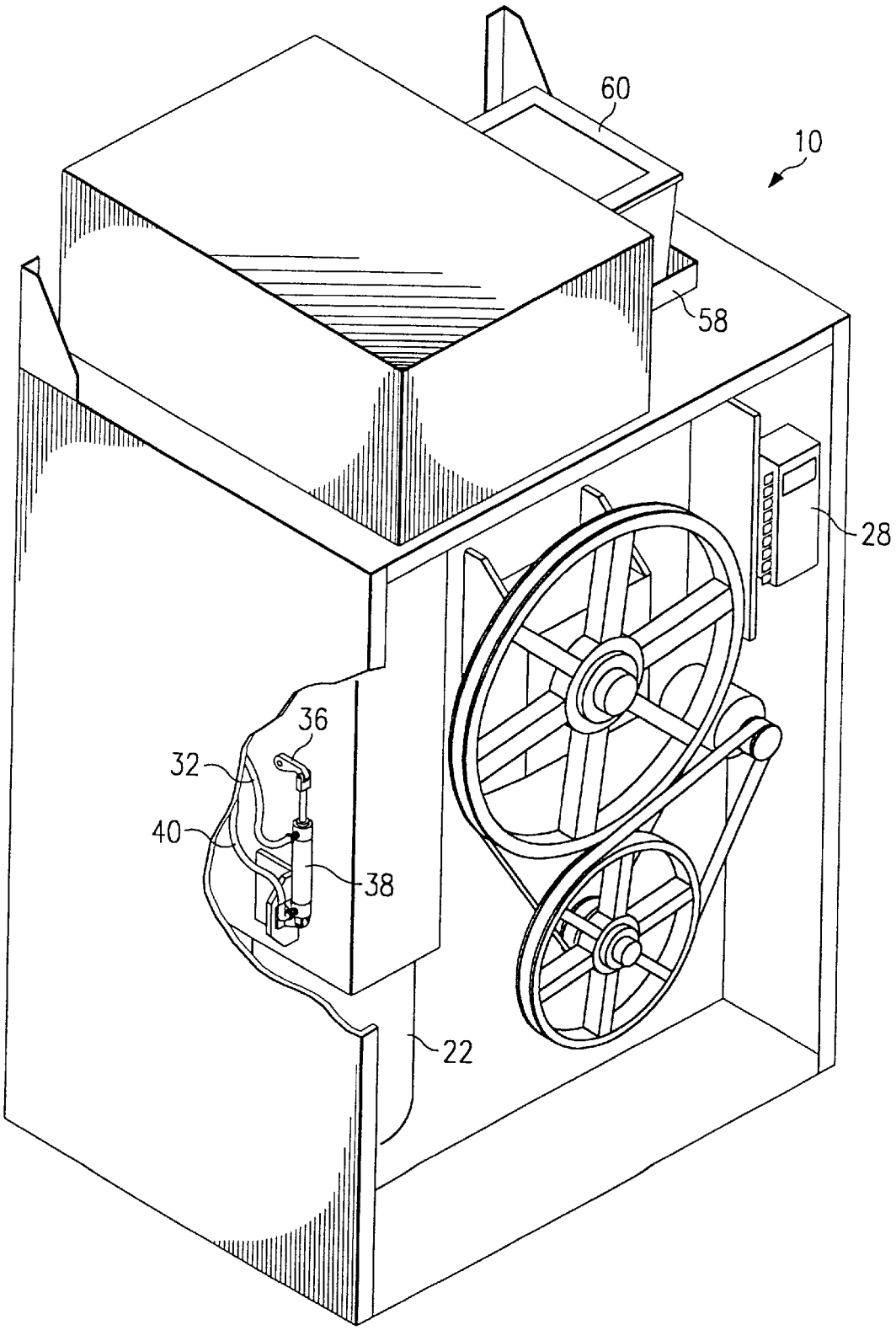
FIG. 2 is a rear perspective view of a modified tumbler/dryer apparatus embodying features of the present invention.

During the operation of the dryer 10, a blower (not shown) causes air to be circulated into the tumbling drum 14 through upper portion of the dryer. Suitable air heating means (not shown) are also provided such as those heating means typically included on commercial dryers, including the preferred dryer identified above, all well known in the art. Referring to FIGS. 1 and 2, provided at the bottom of the dryer and in communication with the interior of the tumbling drum 14 is a lower vent opening 20 through which the circulated air is vented from the tumbling drum 14. The vented air is exhausted exteriorly of the tumbling drum through suitable duct means 22. This construction which circulates air from the top of the dryer and vents through the bottom of the drying apparatus has been found to be particularly suitable for most efficiently wetting garments with durable press resins and other chemicals. This vertically downward airflow configuration is typical with commercial dryers. In contrast, in a typical noncommercial home dryer, air is circulated from the rear or back wall of the drum.

Figure 3:
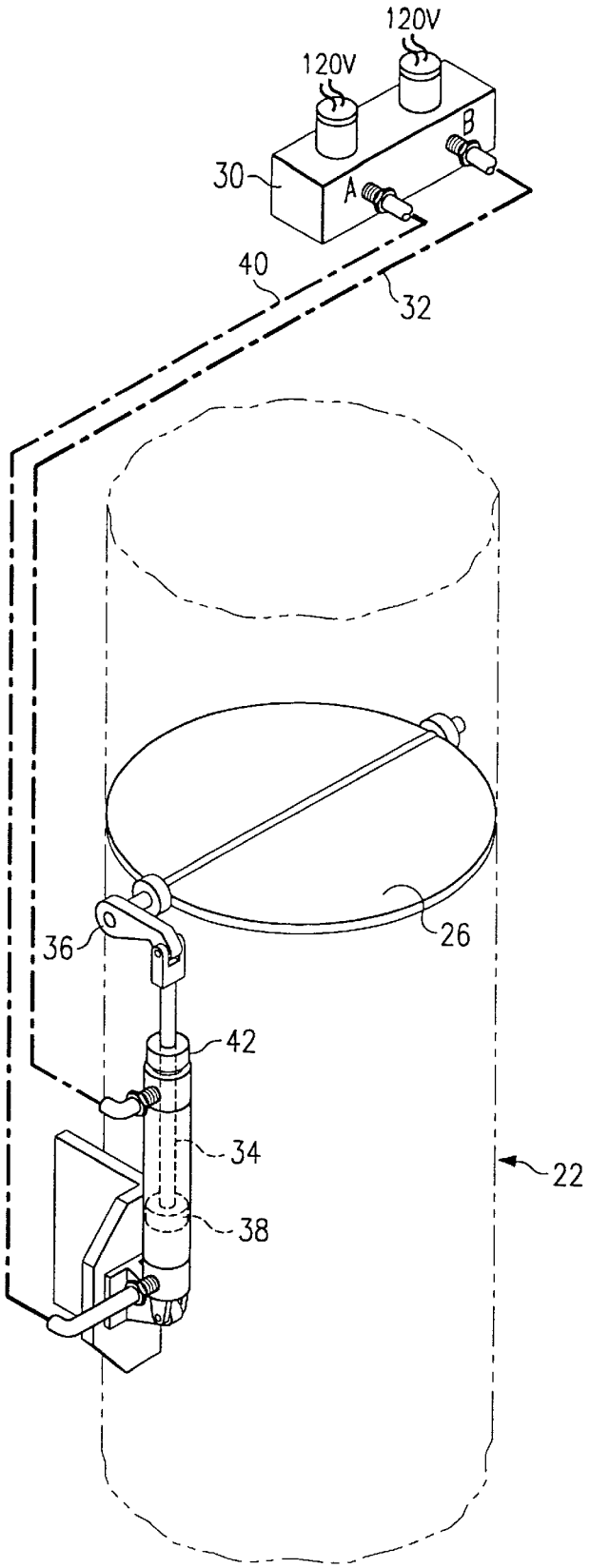
FIG. 3 is a detailed view of the dampener system of the present invention.

Referring to FIGS. 2 and 3, disposed within the exhaust duct means 22 is a dampener 26 to control the flow of air through the tumbling drum 14. The dampener 26 is pneumatically controlled through a programmable controller 28 which is operably connected to the dryer circuitry. A more detailed illustration of the dampener system is provided in FIG. 3.

Referring to FIG. 3, an electronically controlled valve 30 receives signals from the controller 28 (FIG. 2), opening and closing air ports A and B in the valve 30. More particularly, an electronic signal from the controller 28 will energize a solenoid (not shown) in valve 30, allowing air to be supplied by a suitable pressurized air source (not shown) through port B and conduit 32. The air flow from open port B causes air cylinder piston 34, which is operably connected to dampener control arm 36, to move the dampener control arm 36 downwardly, thereby closing the dampener 26. As the control arm 36 and piston 34 move downwardly air is exhausted from the cylinder 38 through conduit 40, which is attached to port A. Conversely, the dampener 26 is moved to the open position, allowing air to flow through the drum and to be exhausted, by removing the electronic signal from the solenoid valve 30, thereby causing air to be supplied through port A. Air supplied through port A and conduit 40 into cylinder 38 moves the piston 34 and arm 36 upwardly, moving the dampener 26 to an open position. Preferably an adjustable stop collar 42 is provided on the air cylinder piston 34 allowing the dampener position to be better controlled. The dampener 26 is adjustable from full open (i.e., maximum exhaust flow) to full close (i.e., no exhaust flow). The use of a dampener (or other suitable means to control the exhaustion of air from the drum) is a significant component of the apparatus, since it has been found that without the dampener (i.e., exhaust fully open) the durable press resin was unevenly distributed on the garments.

In the preferred embodiment of the invention the programmable controller 28, identified by numeral 28 in FIG. 2, may also control all original dryer functions provided on typical commercial dryers, such as heat settings, cycle times, reversing and non-reversing tumbler rotation and air only/cool down cycles. Added functions, both pneumatic and electric, can also be controlled by the controller, such as dampener control, safety circuits, chemical level sensors, and atomizer control. A suitable programmable controller is an Omron Sysmac C28K programmable controller.

Figure 4:
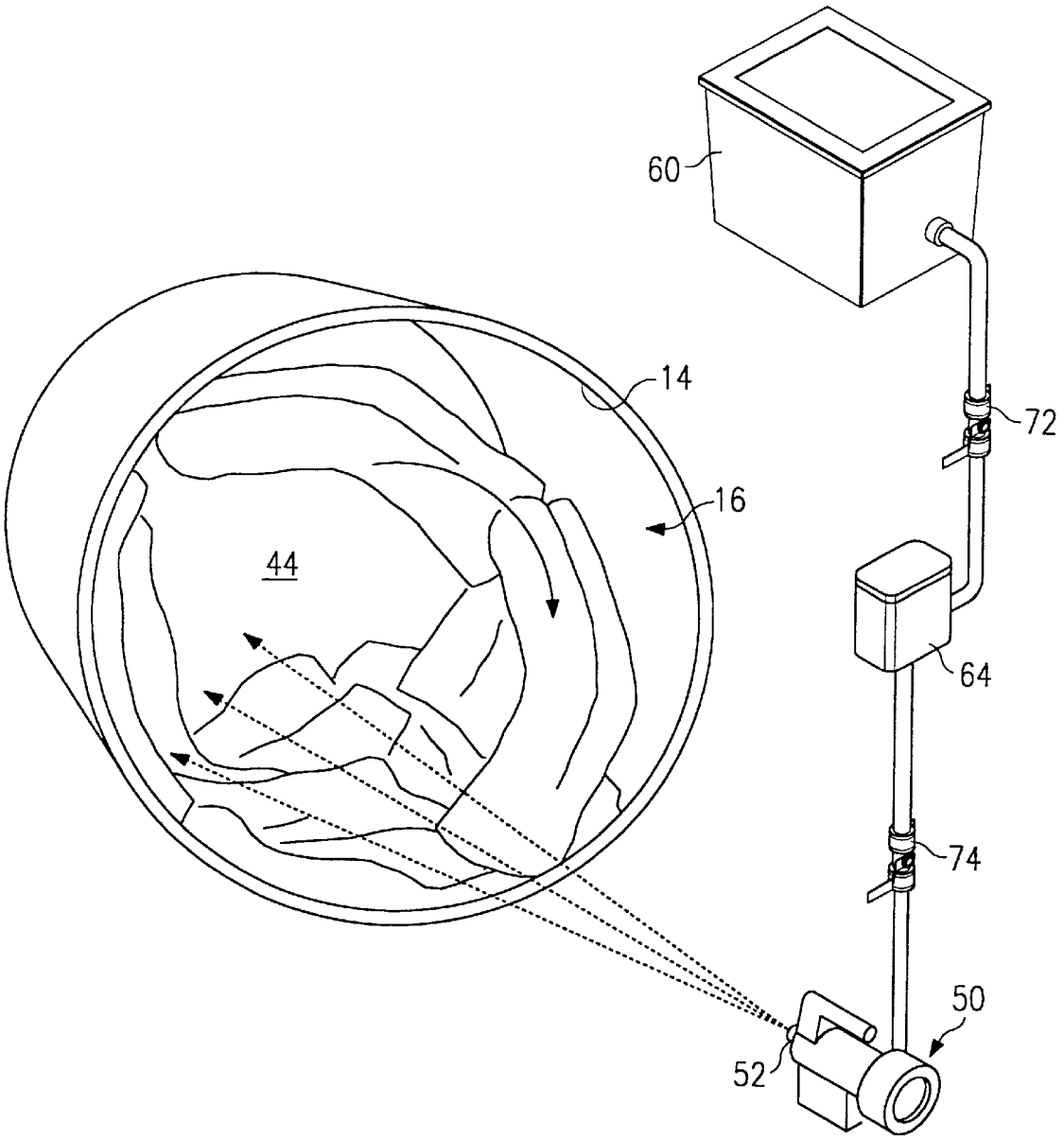
FIG. 4 depicts aspects of the present invention in operation.

In the exemplary embodiment of the invention the tumbling drum 14 is rotating in a clockwise direction as shown in FIG. 4. As shown, the garments to be treated are carried adjacent to the drum 14 until they reach approximately the 10 o'clock position and then fall away from the surface of the tumbling drum 14, descending toward the lower right quadrant of the drum. Thus, when a sufficient amount of garments are loaded into the tumbling drum and the drum is rotated, the garments form a tunnel or cavity 44, i.e., a vortex, as shown in FIG. 4. The formation of this tunnel 44 has been found to be significant in obtaining the most effective treatment and wetting of the garments with durable press resins.

Thus, for optimum performance, it is necessary that there are enough garments to create a "tunneling" effect but not too many garments so as to fold the tunnel. It has been found that the modified Huebsch commercial dryer described above having a 120 lb. capacity and revolving at about 30 revolutions per minute provides an extremely suitable tumbling apparatus. For example, 75 to 110 pounds of dry garments placed in such commercial apparatus will provide a suitable tunnel into which the durable press resin can be injected.

Referring again to FIG. 1, garment access door 18 includes a window 46. Preferably, the original glass window on the Huebsch JT120FG is replaced with a window made of a Lexan material approximately 3/16" thick. Attached to the garment access door window 46 is a support bracket 48 for mounting an atomizer unit 50. The bracket 48 may be attached by any means. For example, holes may be drilled into the access door window 46 to accept the atomizer support bracket 48. The atomizer unit 50 is attached to the door 18 of the tumbling apparatus 10, and is in communication with the interior of the tumbling drum 14. For the purpose of this disclosure, the phrase atomizer unit is defined broadly as a device capable of projecting a liquid in the form of a mist or fine spray. Off the shelf atomizer units are generally suitable and are readily available and well known. A preferred atomizer unit is the Flowtron Model No. MS10OB10-Mister Electric Bug Sprayer.

The atomizer unit 50 injects chemicals (i.e., durable press resins used to impart wrinkle-resistant properties to garments or other articles) through nozzle 52 into the tumbling drum 14 through a hole in the garment access door window 46. An access hole measuring 3A" in diameter should be suitable. The access hole and atomizer unit 50 are preferably positioned off center and to the left side of the door in order to inject the durable press resins into the tunnel formed by the tumbling garments, as shown in FIG. 1. Most preferably, the atomizer unit 50 is positioned such that chemicals are injected toward the lower left, rearward portion of the garment tunnel when the garments are tumbled in a clockwise direction, as shown in FIG. 4. It has been found that by targeting the lower left portion of the tunnel substantially all of the chemical resin is absorbed by the garments and the walls of the tumbler remain substantially dry.

It is believed that when the chemical resin is injected into the garment tunnel the pressure in the tunnel is higher than the pressure adjacent the exhaust vent 20 at the bottom of the dryer 10. It is believed that this pressure differential causes the resin to flow from the inside of the tunnel through the garments toward the low pressure area adjacent the exhaust vent 20. This high pressure-low pressure flow pattern is believed to result in improved wetting by removing the air trapped in the garment and replacing it with chemical. Further, this process is particularly effective with cotton fibers which are hollow and porous, since the pressure differential is believed to result in the removal of air within the hollow cotton fibers and the replacement of such air with durable press resin, thereby resulting in more thorough wetting of the garments and enhanced wrinkle-resistant properties.

Referring to FIGS. 1 and 2, the exemplary embodiment the present invention also includes an external power switch box 54 which includes replaceable in-line fuses to protect against voltage overloads, as well as an emergency on-off switch. The external power switch box 54 also allows the apparatus to be portable within the production facility. Also, mounted to the tumbling apparatus is a manually controlled 120 volt electric outlet 56 for controlling the required voltage to the atomizer unit 50.

A support bracket 58 is mounted on the top of the modified dryer 10 for attaching a main chemical storage tank 60 to the apparatus. In the exemplary embodiment (FIG. 1) the main chemical storage tank 60 has capacity of 10 gallons. Attached to the main chemical storage tank 60 is pipe 62 or other suitable conduit which runs to a mix/measure chemical storage tank 64. In the exemplary embodiment (FIG. 1) the pipe or conduit 62 attaches to the mix/measure chemical storage tank 64 on the top or inlet side 66 of the mix/measure chemical storage tank 64.

The mix/measure chemical storage tank 64 preferably should have sufficient capacity for operating the apparatus for at least a single load, which in the exemplary embodiment described herein equates to about 5–8 minutes operating time. The mix/measure chemical storage tank 64 is attached to the housing 12 by a support bracket 68 preferably mounted on the front side of the housing 12, above the garment access door 18 next to the manually controlled 120 volt outlet 56. In communication with and connected to the bottom of the mix/measure chemical storage tank 64 is tubing 70 connected to the atomizer or misting unit 50 for transferring chemicals to the atomizer unit 50.

Mounted in-line between the main chemical storage tank 60 and the mix/measure storage tank 64 is a manual control ball valve 72 for controlling the flow of chemical between the main chemical storage tank 60 and the mix/measure chemical tank 64. A second manual control ball valve 74 is mounted in line between the mix/measure chemical tank 64 and the atomizer unit 50 for controlling the flow of chemicals therebetween.

The apparatus further includes a process control switch 76 enabling the operator to change from one program to another stored in the program controller 28. In the preferred embodiment, the process control switch 76 allows the operator to change between chemical wetting operations and standard dryer operations.

Figure 5:
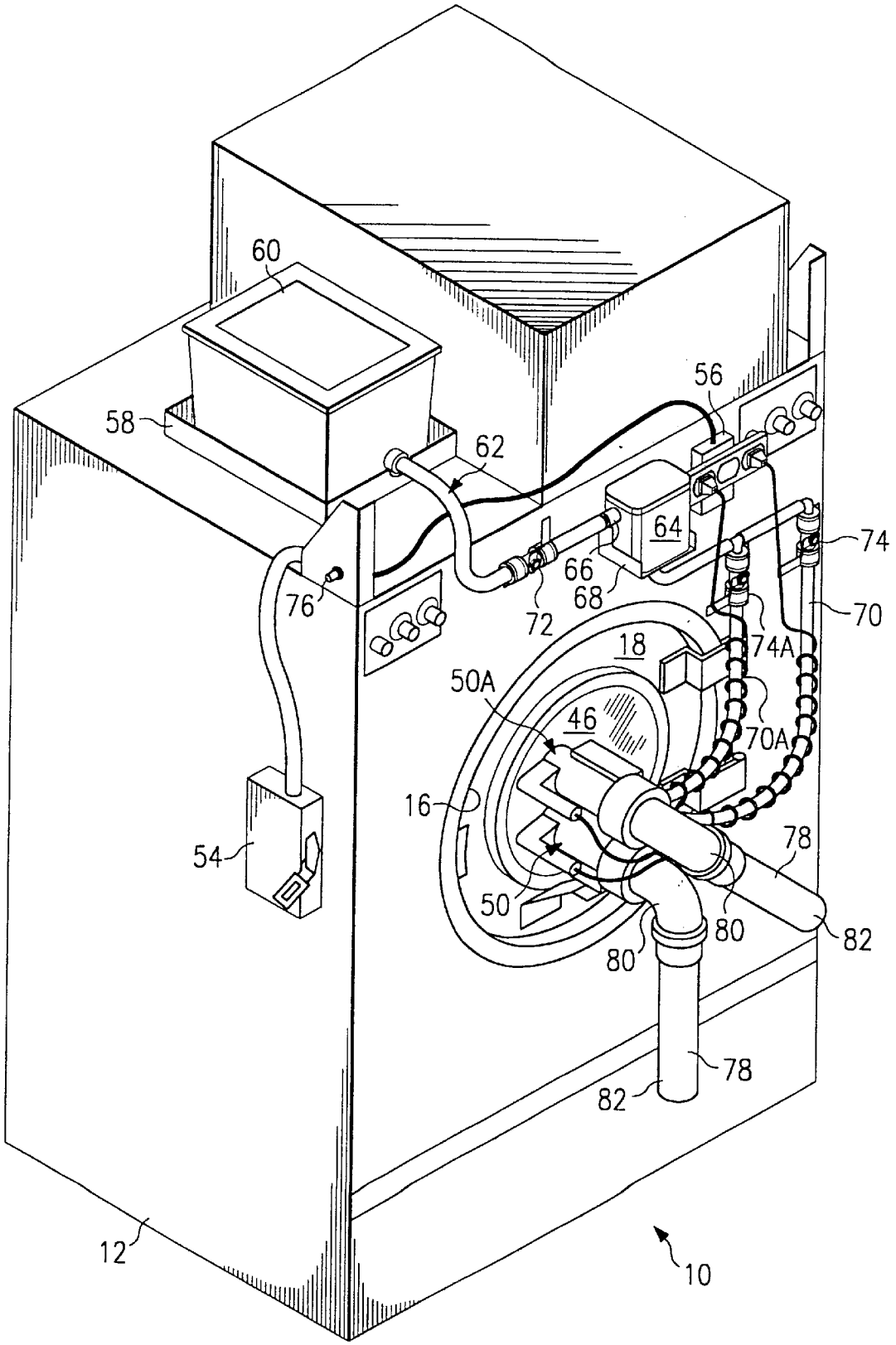
FIG. 5 is a front perspective view of an alternative embodiment of the present invention.

Referring to FIG. 5, there is shown an alternative embodiment of the present invention wherein two atomizer units 50 and 50A are mounted to the access door window 46. The construction of this alternative embodiment is essentially the same as that shown in FIGS. 1–4 except that a second conduit 70A is incorporated to permit flow of resins and other liquids from mix/measure tank 64 to atomizer unit 50A. Additionally, a second manual control ball valve 74A is connected to conduit 70A to control liquid flow to atomizer unit 50A. Also shown in FIG. 5 are noise suppressors 78 connected to atomizer units 50 and 50A at the air inlets thereof. The noise suppressors 78 shown each comprise a 211 PVC elbows So having attached thereto a portion of common flexible electrical conduit 82. The inclusion of a second atomizer unit increases the efficiency of the apparatus by decreasing the amount of time needed to completely wet the garments with resin, while still obtaining maximum utilization of the resin.

The operation of the above-described apparatuses in the manufacture of wrinkle-resistant garments is as follows. Garments or other articles constructed of a cellulose fiber-containing fabric, such as cotton or a cotton-blend garment, are placed into the tumbling drum 14 through access door 18. The door 18 is closed and the tumbling operation is commenced by selecting the proper control commands via the programmable controller. In the operation shown in FIG. 4 the drum is rotating in a clockwise direction and the garments form a tunnel or cavity 44.

While the garments are being tumbled, a durable press resin or agent is fed into the atomizer unit 50 through the mix/measure storage tank 64 and injected into the tumbling drum 14 in the form of a mist. For the purposes of this disclosure, the phrase durable press resin is intended to include any suitable resin, agent or other chemical or chemical compound which imparts wrinkle-resistant properties to fabrics. Suitable durable press resins are well known in the industry and the subject process and apparatus is not limited by the type of durable press resin used. For example, satisfactory results have been achieved using durable press resins produced and sold by Highpoint Chemical Company.

The tumbling and resin injection process is continued until the garments are completely impregnated with resin. Preferably, no excess resin is injected. For example, with the modified Huebsch dryer described above, it has been found that approximately 50 pairs of pants (75 to 110 lbs.) will be 100% wetted by injecting 3½ gallons of resin and tumbling for 15 minutes, without any excess resin accumulating in the tumbling apparatus.

After the garments have been wetted in the subject apparatus, the garments are dried to about 10% moisture by switching the apparatus to the standard drying operation and tumble drying the garments for approximately 20 minutes at 140° F. The garments are then pressed to impart the desired creases and shape to the garment. Pressing the garments at 310° F. for 5 to 30 seconds has been found to be suitable. Next, the garment is placed in a curing oven to cure the resin and thereby impart wrinkle-resistant properties to the garment. Depending on the weight of the garments and the type of fabric, curing temperatures typically range from 280° F. to 310° F. and curing times from 5 to 15 minutes.

Various modifications to and uses of the present apparatus and method have been recognized. For example, various additional treatment fluids may be used in the present invention to get the desired end product, such as denim wash components, softeners and other compounds well known in the art. One "denim wash" compound which has been used in connection with the apparatus disclosed herein and has resulted in the desired garment characteristics is Virco Quickstone 50 manufactured by the Virkler Company. Similar results have been achieved using the present apparatus without the use of enzyme treatments by heating the durable press resin to about 130° F. prior to injection into the drum. To maintain the 130° F. temperature of the durable-press resin, the main chemical storage tank can be insulated.

Although the present invention has been illustrated in the accompanying drawings and described in the foregoing detailed description in terms of certain exemplary and preferred alternative embodiments, it will be understood that the invention is not limited to the embodiments disclosed, but is capable of numerous rearrangements, modifications and substitutions without departing from the scope of the invention.

What is claimed is:

1. A method of manufacturing durable press garments comprising:

(a) inserting garments constructed of a cellulose fiber-containing fabric into an apparatus capable of tumbling said garments about a generally horizontal axis in such a manner as to form a tunnel defined by said garments;

(b) tumbling said garments in such a manner as to form a tunnel defined by said garments, (c) injecting a durable press resin into said tunnel in the form of a mist, thereby impregnating said garments with said durable press resin;

(d) drying the impregnated garments; and (e) curing the dried garments.

2. The method of claim 1 further comprising the step of pressing said dried garments to impart creases and shape to said garments before said garments are cured.

3. The method of claim 2 wherein said tunnel has a rearward portion and a forward portion, said resin being injected into said garment tunnel in a direction generally toward said rearward portion of said garment tunnel.

4. The method of claim 2 wherein said garments are constructed of cotton.

5. The method of claim 2 wherein said curing step includes the step of heating said pressed garments for a time in a range of about five to about fifteen minutes at a temperature in a range of about 280° F. to about 310° F.

6. The method of claim 1 wherein said tunnel has a rearward portion and a forward portion, said resin being injected into said garment tunnel in a direction generally toward said rearward portion of said garment tunnel.

7. The method of claim 1 wherein said garments are constructed of cotton.

8. The method of claim 1 wherein said drying step includes the step of drying said impregnated garments to about 10% moisture.

9. The method of claim 1 wherein said drying step includes the steps of:

tumbling said impregnated garments about said generally horizontal axis; and, injecting heated air in a generally vertically downward direction through said apparatus.

10. The method of claim 1 wherein said drying step includes the step of tumbling said impregnated garments for about twenty minutes at about 140° F.

11. A method of impregnating a cellulose fiber-containing fabric with a durable press resin for the manufacture of durable press articles, said method comprising:

(a) inserting a cellulose fiber-containing fabric into a tumbling apparatus, said tumbling apparatus being capable of tumbling said fabric about a generally horizontal axis in such a manner as to form a tunnel defined by said tumbling fabric;

(b) tumbling said fabric in such a manner as to form a tunnel defined by said fabric;

(c) injecting a durable press resin into said tunnel in the form of a mist, thereby impregnating said fabric with said durable press resin; and (d) drying said impregnated fabric.

12. The method of claim 11 further comprising the step of curing said fabric after the drying step (c) to impart durable press properties to said fabric.

13. The method of claim 12 wherein said tunnel has a rearward portion and a forward portion, said resin being injected into said tunnel in a direction generally toward the rearward portion of said fabric tunnel.

14. The method of claim 12 wherein said fabrics are constructed of cotton.

15. The method of claim 11 wherein said tunnel has a rearward portion and a forward portion, said resin being injected into said tunnel in a direction generally toward the rearward portion of said tunnel.

16. The method of claim 11 wherein said fabric is constructed of cotton.

17. The method of claim 11 including the step of pressing said fabric after the drying step (c) to impart creases and shape to said fabric.

18. The method of claim 17 wherein said curing step includes the step of heating said pressed fabric for a time in a range of about five to about fifteen minutes at a temperature in a range of about 280° F. to about 310° F.

19. The method of claim 11 wherein said drying step includes the step of drying said impregnated fabric to about 10% moisture.

20. The method of claim 11 wherein said drying step includes the steps of:

tumbling said impregnated fabric about said generally horizontal axis; and, injecting heated air in a generally vertically downward direction through said tumbling apparatus.

21. The method of claim 11 wherein said drying step includes the step of tumbling said impregnated fabric for about twenty minutes at about 140° F.

* * * * *